US005353622A

United States Patent [19]

Theener

[11] Patent Number: 5,353,622

[45] Date of Patent: Oct. 11, 1994

[54] ARTICULATED THREE POINT PIPE BENDING APPARATUS

[76] Inventor: Ronald E. Theener, HCR #64, Box 290, Duchesne, Utah 84021-9501

[21] Appl. No.: 150,516

[22] Filed: Nov. 10, 1993

[51] Int. Cl.[5] ..... B21D 7/06

[52] U.S. Cl. ..... 72/380; 72/383; 72/386; 72/387

[58] Field of Search ..... 72/380, 383, 386, 387, 72/388, 389

[56] References Cited

U.S. PATENT DOCUMENTS

| | | | |
|---|---|---|---|
| 2,938,564 | 5/1960 | Rhodes | 72/383 |
| 3,934,450 | 1/1976 | Reed | 72/383 |
| 4,331,018 | 5/1982 | Doyle | 72/389 |
| 4,416,136 | 11/1983 | Schwarze | 72/157 |
| 4,727,738 | 3/1988 | Yogo | 72/157 |
| 4,888,971 | 12/1989 | Schwarze | 72/157 |
| 5,010,758 | 4/1991 | Togoshi | 72/157 |
| 5,237,847 | 8/1993 | Owens | 72/389 |

FOREIGN PATENT DOCUMENTS

| | | | |
|---|---|---|---|
| 1113198 | 8/1961 | Fed. Rep. of Germany | 72/383 |

*Primary Examiner*—David Jones
*Attorney, Agent, or Firm*—Henderson & Sturm

[57] ABSTRACT

A pipe bending apparatus (10) for bending a section of pipe (100) at a desired location; wherein, the apparatus (10) comprises; a floating central hinge plate member (40) pivotally connected on opposite ends to a pair of bending bed members (30) which move the section of pipe (100) against a pipe bending template (50) in response to the actuation of a hydraulic unit (15) to produce a bend in the section of pipe.

7 Claims, 5 Drawing Sheets

ARTICULATED THREE POINT PIPE BENDING APPARATUS

TECHNICAL FIELD

The present invention relates to the field of pipe bending devices in general, and in particular to an articulated three point pipe bending apparatus.

BACKGROUND ART

This invention was the subject matter of Document Disclosure Program Registration No. 298,930 which was filed in the United States Patent and Trademark Office on Jan. 21, 1992.

As can be seen by reference to the following U.S. Pat. Nos. 4,416,136; 4,727,738; 5,010,758; and 4,888,971; the prior art is replete with myriad and diverse pipe bending devices.

While all of the aforementioned prior art constructions are more than adequate for the basic purpose and function for which they have been specifically designed, these patented devices have been uniformly deficient with regard to the fact that they are neither designed nor intended to produce acute bends proximate the ends of the section of pipe; in as much as they do not have the floating fulcrum that is provided by the subject matter of the present invention.

As a consequence of the foregoing situation, there has existed a longstanding need among those individuals who experience the necessity of imparting bends proximate either end of a section of pipe which is a feature that is not available in the prior art patents; and, the provision of such a construction is a stated objective of the present invention.

DISCLOSURE OF THE INVENTION

Briefly stated, the pipe bending apparatus that forms the basis of the present invention comprises a rigid framework unit; a pair of bed units; a central hinge unit; a pipe engaging unit; and a hydraulic unit, Each of the bed units are operatively connected to the hinge unit and the bed units and hinge unit are independently connected to the hydraulic unit such that three independently directed bending forces can be applied at spaced locations along the length of the section of pipe that is being subjected to the bending process.

As will be explained in greater detail further on in the specification, the three point application of force produced by this apparatus allows pronounced bends to be imparted to a section of pipe even when the bend is located proximate to one of the ends of the section of pipe.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
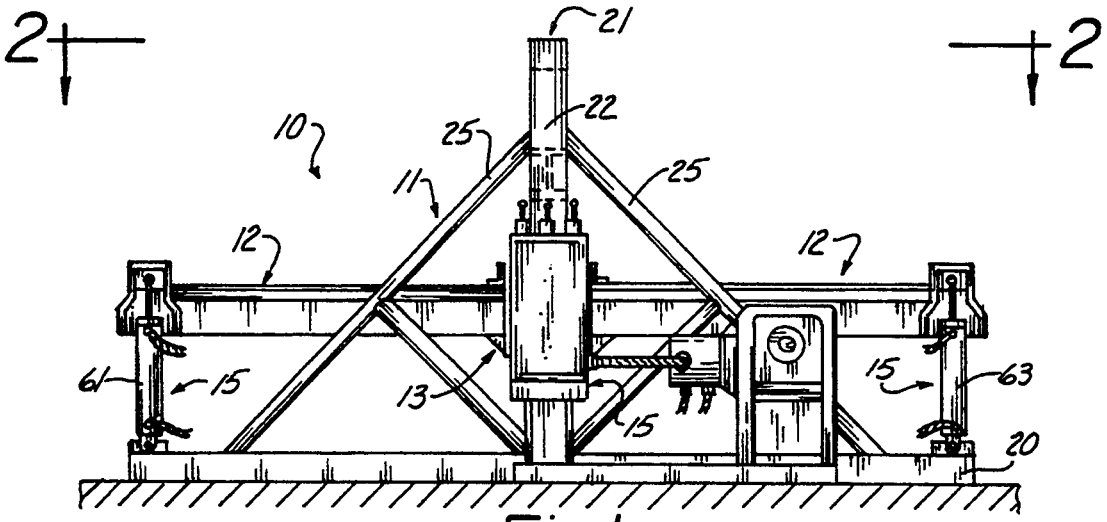
FIG. 1 is a front elevation view of the pipe bending apparatus of this invention.
Figure 3:
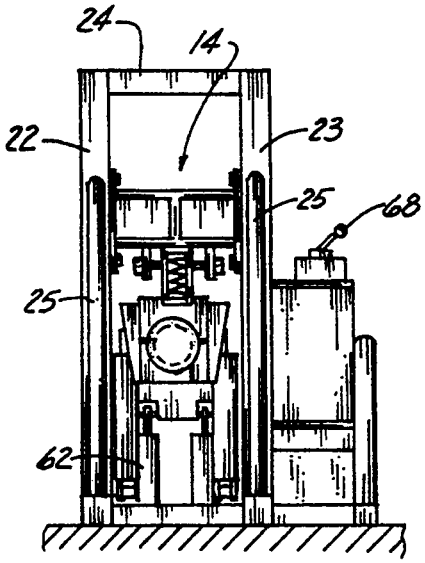
FIG. 3 is a side elevation view of the left end of the pipe bending apparatus.

As can be seen by reference to the drawings, and in particular to FIGS. 1 and 3, the pipe bending apparatus that forms the basis of the present invention is designated generally by the reference numeral (10). The apparatus (10) comprises in general: a rigid framework unit (11); a pair of bed units (12); a floating hinge unit (13); a pipe engaging unit (14); and, a hydraulic unit (15). These units will now be described in seriatim fashion.

Figure 2:
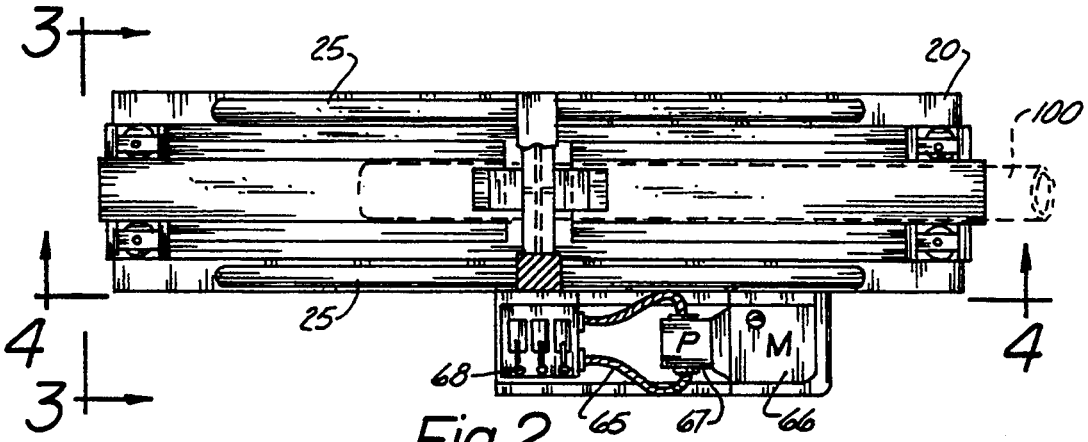
FIG. 2 is a top plan view of the pipe bending apparatus.

As shown in FIGS. 1 through 3, the framework unit (11) comprises an elongated generally rectangular flat rigid base member (20) having a centrally disposed vertical support element (21) including a pair of rigid vertical support arms (22) (23) connected on their lower ends to the base member (20), wherein, the upper ends are connected to one another by a cross-piece (24). In addition, a plurality of angled brace elements (25) are provided between the base member (20) and the support element (21) to provide additional rigidity and support thereto.

Figure 4:
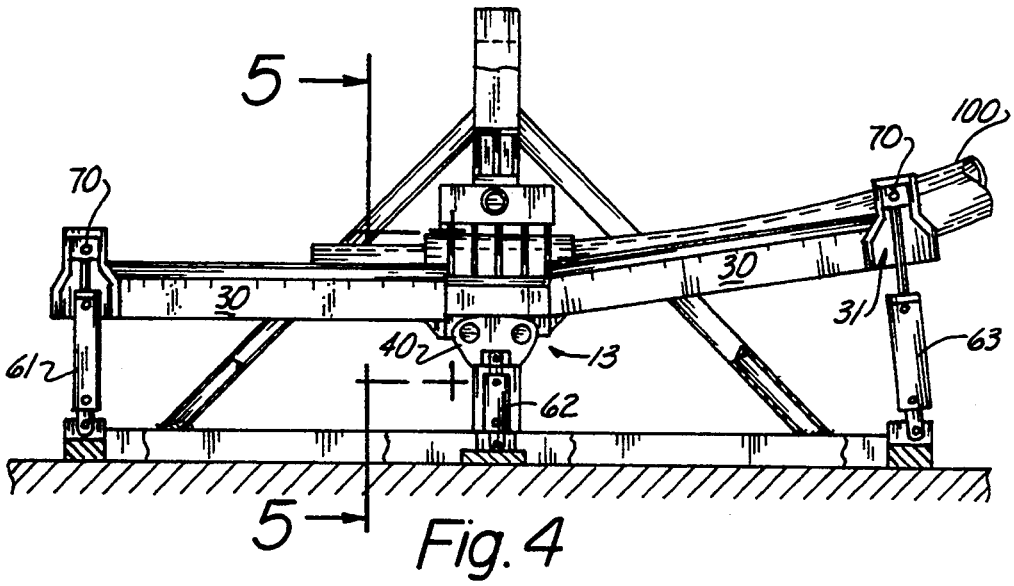
FIG. 4 is a side elevation view of the apparatus with one of the bed units in the raised position.
Figure 6:
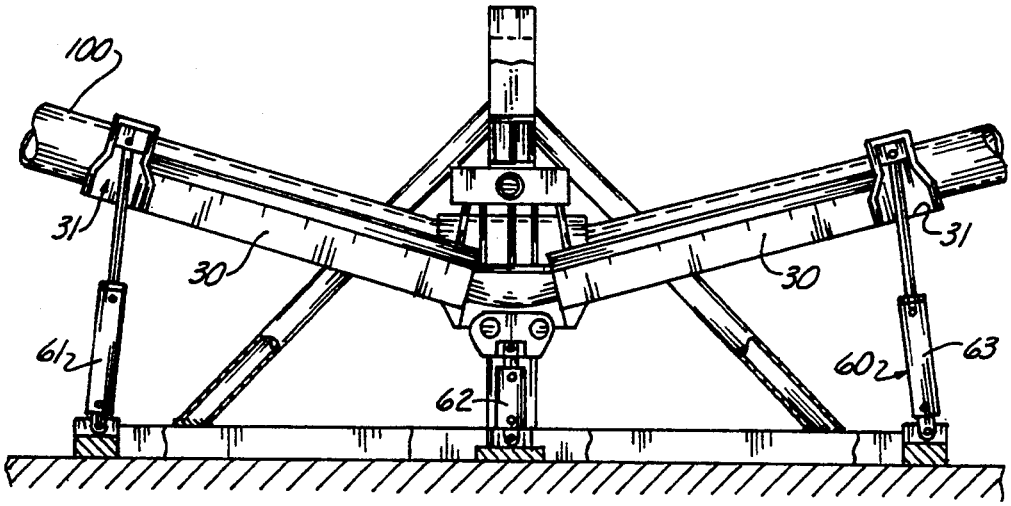
FIG. 6 is a front elevation view of the apparatus with both of the bed units in the raised position.
Figure 9:
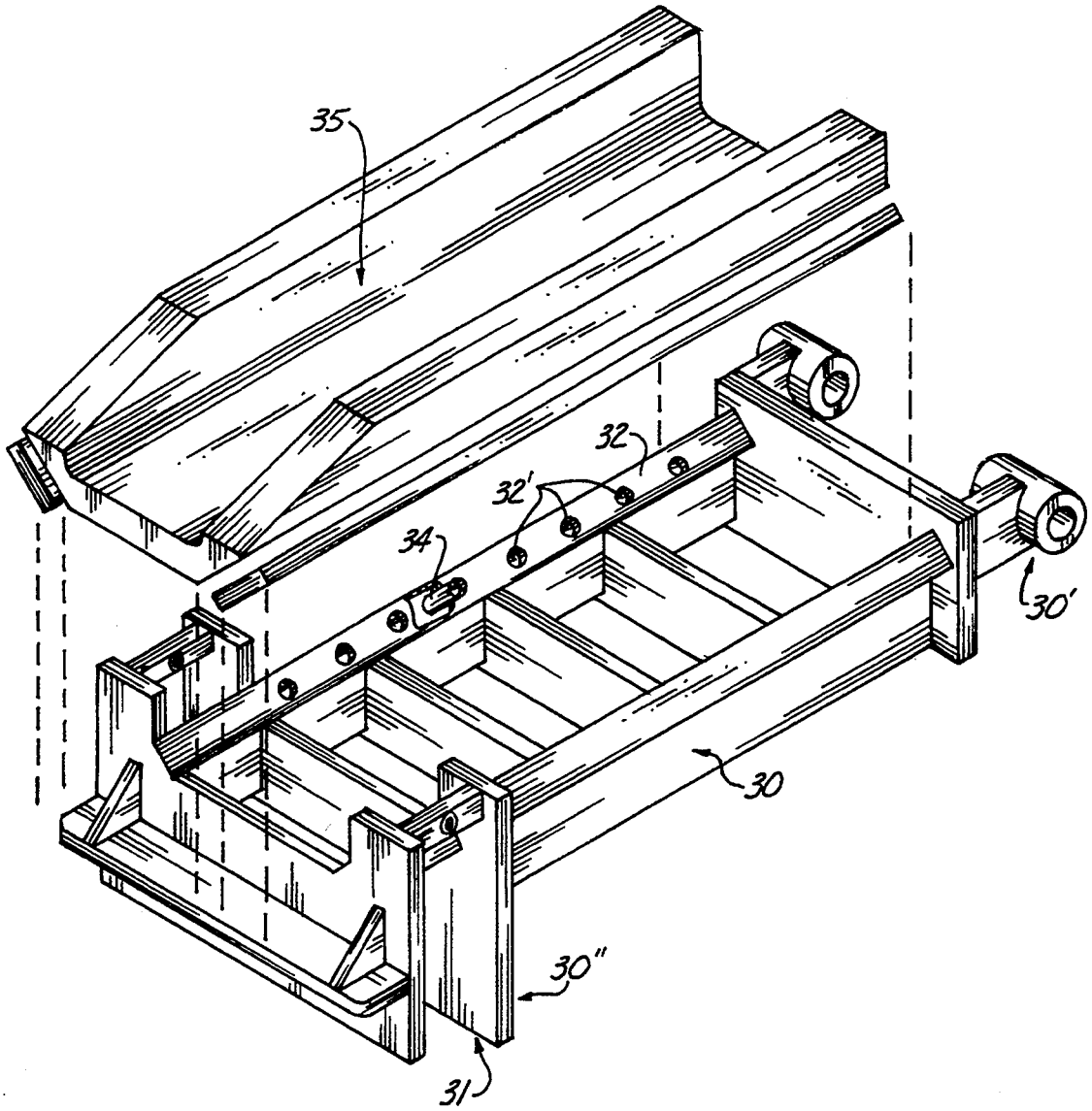
FIG. 9 is an exploded perspective view showing the operative engagement between one of the bending bed arms and its associated pipe die; and, FIG. 10 is a schematic diagram of the hydraulic unit that controls the operation of the apparatus.

As can best be seen by reference to FIGS. 4, 6 and 9 each of the bed units (12) comprise an elongated rigid bed member (30) which is pivotally connected on their inboard ends (30″) to the floating hinge unit (13); wherein, the outboard end (30′) of each bed member (30) is provided with a recess (31) which is operatively associated with a portion of the hydraulic unit (15).

Figure 8:
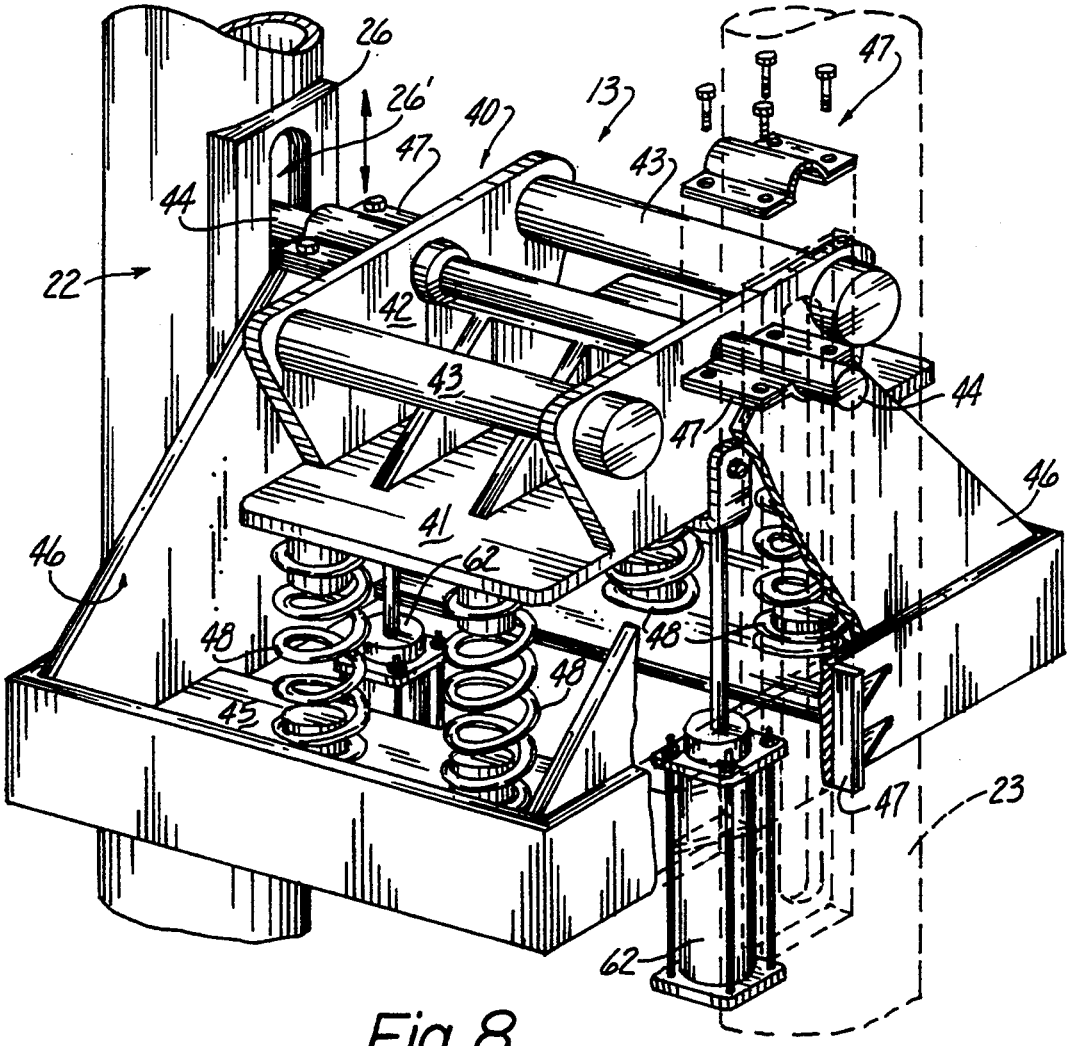
FIG. 8 is an isolated detail view of the floating hinge plate and strongback assembly that lies at the heart of this invention.

As shown in FIG. 8, the floating hinge unit (13) comprises a hinge plate member (40) which includes a generally rectangular base plate (41) provided with a pair of spaced raised flanges (42) apertured to receive a pair of pivot rods (43) which are operatively engaged to the inboard ends (30′) of the bed members (30) in a well recognized fashion.

In addition each of the raised flanges (42) are further provided with a centrally disposed and outwardly projecting axle stub (44); wherein, the axle stubs (44) are dimensioned to be received in elongated slots (26′) formed in a vertical raceway (26) associated with the interior face each of the vertical support arms (22)(23) of the support unit (11).

As can also been seen by reference to FIG. 8, the floating hinge unit (13) also includes a strongback assembly pivotally suspended from the outwardly projecting axle stubs (44); wherein, the strongback assembly comprises a rectangular base element (45) having generally triangular ear elements (46) projecting upwardly from the opposite sides of the base element (45).

In addition, the upper end of each ear element (46) is further provided with a hub assembly (47) for pivotally suspending the ear elements (46) from the axle stubs (44) in a well recognized manner; and, each ear element (46) is also provided with guide flanges (47) which engage the outer surfaces of the vertical raceways (26) on each of the vertical support arms (22)(23).

Still referring to FIG. 8, it can be seen that a plurality of helical spring elements (48) are operatively disposed between the front and rear portions of both the top of the strongback base element (45) and the bottom of the base plate (41) of the hinge plate member (40), for the purpose of resisting the pivotal displacement of the hinge plate member (40) relative to the strongback assembly.

Figure 5:
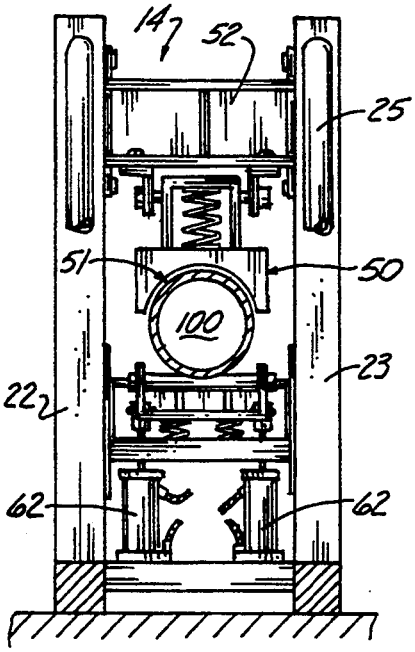
FIG. 5 is a cross-sectional view of the apparatus taken through line 5—5 of FIG. 4.

As can best be seen by reference to FIGS. 3 and 5, the pipe capture unit (14) comprises a conventional pipe bending template member (50) having an arcuate contoured recess (51) formed therein; wherein, the contoured recess (51) conforms to the shape of the bend which is to be imparted to the section of pipe (100).

In addition the template member (50) is operatively and pivotally secured to a carriage member (52) which is operatively and movably associated with the vertical support arms (22) (23) of the framework member (20); wherein, the carriage member (52) is provided with means for locking the carriage member (52) at a selected height relative to the support arms (22) (23).

Figure 10:
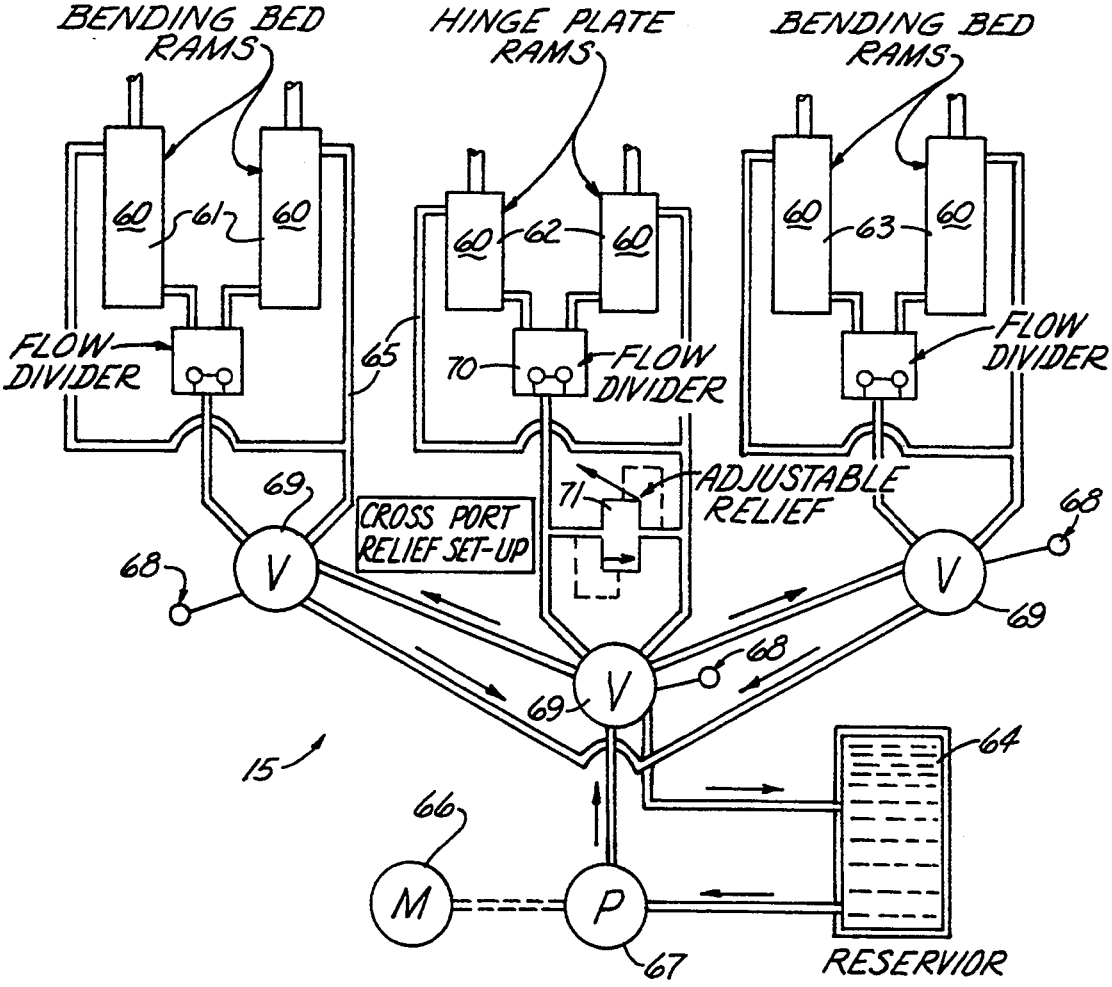

Turning now to FIGS. 4 through 5 and 10, it can be seen that the hydraulic unit (15) comprises three independently controlled pairs (61) (62) (63) of hydraulic cylinders (60) operatively connected to a hydraulic reservoir (64) via hydraulic lines (65). In addition a motor (66) is provided to force the hydraulic fluid through a pump (67); wherein, the delivery of the hydraulic fluid into the three independently operated cylinder pairs (61) (62) (63) is accomplished through the actuation of control levers (68) which operate conventional hydraulic control valves (69).

The first (61) and third (63) pairs of hydraulic cylinders have their lower ends pivotally secured to opposite ends of the base member (20); wherein the upper ends of the hydraulic cylinders (61) (63) are operatively connected to the outboard ends (30″) of the bending bed members (30) via pivoted brackets (70) which are dimensioned to be received in the upper ends of the recesses (31) formed in the outboard ends of the bed members (30).

In addition the second pair of hydraulic cylinders (62) are connected on their lower ends to opposite sides of the central portion of the base member (20); wherein, the upper ends of the hydraulic cylinders (62) are operatively connected to the bottom of the floating hinge plate member (40).

It should also be noted at this juncture that the hydraulic unit (15) of this invention also employs cross-porting relief disposed beneath the floating hinge plate member (40) so as to back-off the cylinder pairs as needed to prevent the flattening of the sections of pipe (100).

As shown in FIG. 10, the cross-port relief is accomplished with the flow divider (70) and adjustable relief valve (71) being in communication with the lower or extending portion of the cylinder pair (62) which supports the floating hinge plate member (40) and the upper or retracting side of the cylinder pair (62) to allow the pipe to belly naturally under the pipe capture unit (14) to keep the pipe from flattening.

Turning once more to FIG. 9 it can be seen that each of the bending bed members (30) are provided with upwardly angled mounting flanges (32) provided with a plurality of opposed and equally spaced apertures (32′) dimensioned to receive anchor pins (34) for adjustably securing pipe dies (35) at various locations relative to the bending template (51).

The operation of the pipe bending apparatus (10) that forms the basis of the present invention proceeds as follows. First a section of pipe (100) is placed along one of the pipe dies (35) on one of the bending bed members (30) and positioned a selected distance along the pipe die (35) on the other bending bed member (30) such that the floating hinge plate (40) is positioned beneath the section of pipe (100) where the bend is to be made.

Figure 7:
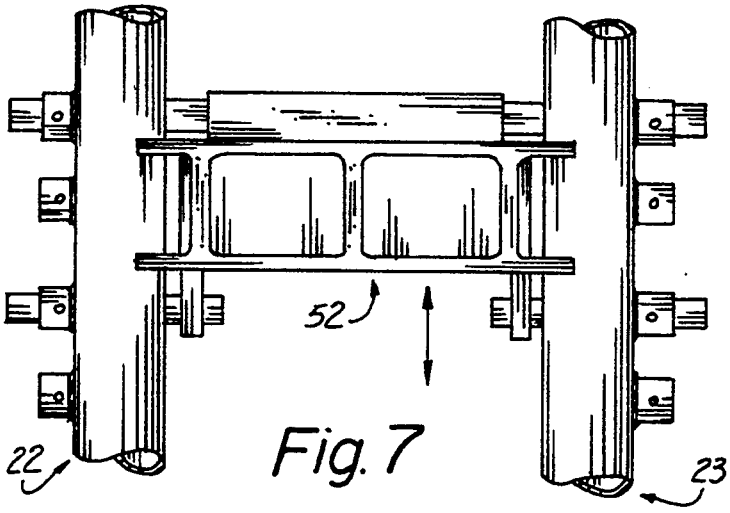
FIG. 7 is an isolated detail view of the carriage member holding a conventional bending template.

At this juncture as shown in FIG. 7 the carriage member (52) is positioned on the support arms (22) (23) to place the bending template in contact with the top of the section of pipe (100).

Then once the section of pipe (100) has been properly positioned relative to the apparatus (10), the three pairs (61) (62) (63) of hydraulic cylinders are selectively and independently actuated via the control levers (68) to raise and lower the bending beds (30) and the floating hinge plate (40) to produce the desired bend in the section of pipe (100).

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A pipe bending apparatus for bending a section of pipe; wherein, the apparatus comprises:

a base member provided with a pair of vertical support arms disposed proximate the midpoint of the base member;

a carriage member operatively associated with said support arms;

a template member attached to the bottom of said carriage member and further provided with a contoured recess dimensioned to engage the top surface of said section of pipe;

a floating hinge plate member mounted for both pivotal and vertical reciprocation relative to said pair of vertical support arms;

a pair of bending bed members provided with moveable pipe dies and pivotally connected on opposite ends of said hinge plate member; and, means for moving said bending bed members and said floating hinge plate member relative to both one another and said template member to produce a bend in said section of pipe.

2. The apparatus as in claim 1 further comprising a spring biasing means disposed on said floating hinge plate member; and a strongback assembly suspended from said floating hinge plate member; wherein, said spring biasing means are disposed intermediate the strong back assembly and the floating hinge plate member.

3. The apparatus as in claim 1; wherein the strongback assembly is further provided with guide means which cooperate with the pair of vertical support arms for maintaining the strongback assembly in a selected disposition relative to the support arms as the floating hinge plate member is vertically displaced relative to said pair of support arms.

4. The apparatus as in claim 1; wherein, said means for moving said bending bed members and said floating hinge plate member comprise a plurality of hydraulic cylinders.

5. The apparatus as in claim 1; wherein, each of said bending bed members and said hinge plate members are provided with opposed pairs of independently actuated hydraulic cylinders.

6. The apparatus as in claim 5; wherein, each of said bending bed members have a pair of hydraulic cylinders operatively associated with the outboard end of each bending bed member and one end of the base member.

7. The apparatus as in claim 6, wherein, the hinge plate member is provided with a pair of hydraulic cylinders which are connected on one end to the bottom of the hinge plate, and connected on the other end to the base member.

* * * * *